United States Patent [19]

Ueno et al.

[11] 3,959,836

[45] June 1, 1976

[54] PRINTING PROCESS

[75] Inventors: Eichiro Ueno, Wakayama; Hideo Kawasaki, Moriyama; Syozo Shigita, Hirakata, all of Japan

[73] Assignee: American Cyanamid Company, Stamford, Conn.

[22] Filed: Dec. 13, 1973

[21] Appl. No.: 424,407

[52] U.S. Cl. ..... 8/21 A; 8/83

[51] Int. Cl.[2] ..... D06P 3/82

[58] Field of Search ..... 8/21 A, 83

[56] References Cited

UNITED STATES PATENTS

| | | | |
|---|---|---|---|
| 2,922,690 | 1/1960 | Mueller et al. | 8/21 A |
| 3,660,008 | 5/1972 | Kissa | 8/21 A |
| 3,706,524 | 12/1972 | Flensberg et al. | 8/21 A |

FOREIGN PATENTS OR APPLICATIONS

| | | | |
|---|---|---|---|
| 986,034 | 3/1965 | United Kingdom | 8/21 A |

*Primary Examiner*—William F. Hamrock

*Attorney, Agent, or Firm*—William J. van Loo

[57] ABSTRACT

In the printing of fiber assemblages containing acrylic fibers dyeable with cationic dyes and blend fibers dyeable with anionic dyes, there is disclosed a process for printing with a printing paste containing a cationic and a anionic dye which comprises preparing the printing paste so as to contain specific amounts of lignin sulfonic acid or a soluble salt thereof, printing the fiber assemblage with said paste, and thereafter steaming the printed assemblage to fix the dyes thereon.

6 Claims, No Drawings

PRINTING PROCESS

This invention relates to an improved process for printing a fiber blend with dyes of opposing ionic charges. More particularly, the invention relates to a process for printing a fiber assemblage containing acrylic fibers dyeable with basic dyes and blend fibers dyeable with acid dyes, the printing paste containing a mixture of cationic and anionic dyes which are stabilized against interaction and precipitation by addition of a specific amount of lignin sulfonic acid or a salt thereof to the printing paste.

When a fiber assemblage such as blend-spun, blend-woven, or blend-knit articles consisting of commercially available cationic-dyeable acrylic fibers and anionic-dyeable fibers such as cotton, wool, rayon, nylon, and the like are dyed using conventional immersion dyeing techniques, it has been customary procedure to dye the acrylic fiber with a cationic dye and the blend fiber with an anionic dye in conformity with the dyeing characteristics of the respective fibers employed. However, when dyes of opposing ionic nature are present in the same dye bath, complex formation will occur and give rise to precipitation of the dyes. This precipitation causes uneven dyeing of the fiber assemblage being dyed and makes it impossible to dye the fibers in the desired color shades. Additional problems also arise such as loss of dye, fouling of dyeing equipment, and rendering of the fiber assemblage valueless as a commodity. For these reasons, when dyeing of such fiber blends is contemplated using a mixture of cationic and anionic dyes, it has been necessary to add various antiprecipitants to the dye baths to prevent these problems from occuring.

However, in the case of printing such fiber assemblages with cationic and anionic dyes, the situation is entirely different from immersion dyeing which involves a very large ratio of dye bath to fiber assemblage. Because of the very high dye concentrations employed in printing pastes, problems arise with respect to precipitation and paste stability which cannot be corrected by use of the conventional antiprecipitants used in conjunction with dye baths for immersion dyeing. As a result, in printing a fiber assemblage composed of cationic-dyeable fibers and anionic-dyeable fibers, it has been considered extremely difficult to use ionic dyes of opposing charge and recourse has been had to pigment printing, with full knowledge of its deficiencies, e.g. poor resistance to crocking, harsh feel of the printed assemblages, and the like.

In accordance with the present invention, there is provided a process for printing a fiber assemblage comprising acrylic fibers dyeable with cationic dyes and blend fibers dyeable with anionic dyes with a printing paste containing a cationic dye and an anionic dye which process comprises preparing said printing paste so as to contain lignin sulfonic acid or a soluble salt thereof in an amount by weight greater than the total amounts by weight of cationic and anionic dyes present, printing said fiber assemblage with the thus-prepared printing paste and thereafter steaming the thus-treated fiber assemblage to fix the dyes thereon.

The present invention prevents precipitation of dyes, provides a stable printing paste, and overcomes the deficiencies of the prior printing processes used for the particular fiber assemblages.

Although the present inventors do not know the exact mechanism by which the printing paste is stabilized and they do not wish to be bound by any theory, it is their opinion that the anions of lignin sulfonic acid or its soluble salts form a soluble complex with the cationic dye and thus prevent its precipitation in the presence of an anionic dye, and further, that lignin sulfonate cationic dye complex formed does not interfere with adsorption of the cationic dye by the acrylic fiber upon subsequent steaming.

When reactive dyes as used to dye anionic dyeable cellulose fibers, it is customary to add an alkali to accelerate the reaction. Because the addition of alkali to the conventional printing pastes causes instability thereof, it is customary to treat the fiber assemblage with an alkali in a separate bath. However, in accordance with the present invention, it is possible to add the alkali to the printing paste without causing instability, and the dyeing procedure in such instances can be shortened. Using a printing paste containing the alkali accelerator improves the dimensional stability of the fiber assemblage and provides improved touch characteristics to the printed assemblage.

Since the present process employs ionic dyes, it avoids those deficiencies associated with pigment printing such as dull colors, poor resistance to crocking, harsh feel and the like. Thus, the process provides printed fiber assemblages having sharp and level color patterns that are of high commodity value.

As the cationic-dyeable fibers useful in the present invention are employed acrylic fibers containing acid groups, such as sulfonic and carboxylic acid groups, or a mixture of such fibers. The acrylic fibers are produced from acrylonitrile polymers containing at least about 40 weight percent acrylonitrile. Typical of such fibers are those commercially available under such trademarks as Orlon, Creslan, Exlan, Acrilan and the like representing acrylic fibers and Dynel and the like representing modacrylic fibers. Monocomponent or composite fibers may be employed. It is also possible to employ polyester fibers which have been rendered cationic-dyeable by introduction of a suitable acid group.

As anionic-dyeable fibers, there can be used such fibers as cotton, ramie, rayon, cuprammonium rayon, and similar cellulose fibers; animal fibers such as wool, cashmere, and the like; protein fibers; polyamide fibers made anionic-dyeable by introduction of a suitable basic group.

Preferred fiber assemblages include woven or knit fabrics, carpets, and the like made from blended yarns or blend-twisted yarns made of at least two fiber types, one being cationic-dyeable and the other anionic-dyeable, and such other fibers as may be desired. In addition, blend-woven or blend-knit fabrics, non-woven fabrics, and the like of the same required two fiber types may be employed. Blended yarns are obtained by mixing the fibers prior to yarn spinning. Blend-twisted yarns result from plying yarns of different fiber types using a yarn twister. Blend-woven fabrics result from use of yarns of different types in the weaving process. Blend-knit fabrics result from yarns of different types in the knitting process. Preferably, a flat shaped fiber assemblage is employed.

In preparing the printing paste of the present invention, a conventional paste-forming material is employed. Such materials include sodium alginate, starch, processed starches, modified cellulose products such as carboxymethyl cellulose, crystal gum, locust bean gum or modified products thereof, and emulsion pastes, which are paste solutions containing an emulsifying agent. A preferred paste material is carboxymethyl cellulose. The paste-forming material is prepared in aqueous medium in accordance with conventional procedures.

It is next determined which dyes are to be employed and the amounts thereof that are to be present in the printing paste. Once the dye content has been ascertained, an amount by weight of lignin sulfonic acid or a soluble salt thereof that is in excess of the contemplated total dye usage by weight is added to the printing paste and dissolved therein. Soluble salts include the sodium and calcium salts, for example. If the amount of lignin sulfonic acid or soluble salt thereof is less than the total content of dyes in the printing paste, it is difficult to prevent precipitation of dyes by interaction between opposing ionic types. A preferred upper limit in usage thereof in the printing paste is about 9 weight percent based on the total weight thereof. The use of an excessive amount of lignin sulfonic acid or salt thereof is undesirable because it can adversely affect the viscosity of the printing paste or the adsorbency of the cationic dye. A particularly desirable range of use of lignin sulfonic acid or salt thereof is from about 2 to 8 weight percent based on the total weight of the pringing paste. It is of course, to be understood that the set level of lignin sulfonic acid or salt thereof will exceed the total level of ionic dyes present.

The anionic dyes used in the present invention include acid dyes, metallized complex salt dyes, reactive dyes, direct dyes, and the like. These dyes are readily available commercially.

Any of the commercially avalable cationic dyes conventionally employed to dye acrylic fibers having sites for basic dyes may be employed.

The cationic and acid dyes are added to the printing paste which has been modified with lignin sulfonic acid or a salt thereof in accordance with conventional procedures. Typically the dyes are separately dissolved in water and then added to the printing paste. Upon complete addition of ingredients, the printing paste is adjusted to proper use level.

Printing auxiliaries such as urea, thiodiethylene glycol, and the like may be added to the printing paste if desired.

When a reactive dye is used as the anionic dye in the printing paste, it is desirable to add an auxiliary such as a polyamine complex salt, a trichloracetate, etc. which changes from neutrality to alkalinity under the influence of steaming the printed fiber assemblage. The use of such an auxilary not only remarkable reduces hydrolysis of the reactive dye and improves its color development but also enables elimination of the alkali treatment step, thus shortening the printing process.

After the printing paste has been prepared as indicated, the fiber assemblage is printed therewith in accordance with conventional procedures. Use may be made of engraved printing rolls or printing screens, for example.

After the fiber assemblage has been printed, it is subjected to the conventional steaming procedure to fix the dyes on the fiber assemblage. Desirably, the stem treatment is carried out at a temperature in the range of about 95° to 120°C., preferably 105° to 115°C., for at least about 5 minutes.

After steaming, the fiber assemblage is subjected to the conventional steps of washing, rinsing, and drying.

Further processing to the desired fiber product may then be carried out, as necessary.

The invention is more fully illustrated by the examples which follow, wherein all parts and percentages are by weight unless otherwise specifically designated.

EXAMPLE 1

A stock paste consiting of 7.5 weight percent of carboxymethyl cellulose and 7.5 weight percent of sodium lignin sulfonate in water was prepared for use in this and subsequent examples.

A dye paste utilizing a portion of the stock paste was prepared in conventional manner to have the following composition:

| | |
|---|---|
| C.I. Reactive Yellow 11 | 1 part |
| C.I. Basic Yellow 51 | 1 part |
| Thiodiethylene Glycol | 1 part |
| Acetic Acid | 1 part |
| Stock Paste | 60 parts |
| Urea | 6 parts |
| Polyamine Complex Salt (Remasol Salt FD) | 2 parts |
| Water | 28 parts |
| Total | 100 parts |

A knit fabric produced from blended yarn containing 50 parts of cotton was printed therewith in accordance with conventional procedure. The printed fabric was then steamed at 100°C. for 15 minutes and then washed, rinsed, and dried.

The fabric obtained assumed a pattern of sharp yellow color on both acrylic and cotton fiber contents. There was no evidence of precipitated dye and the fabric exhibited good color fastness and good resistance to crocking.

By way of comparison, when the above printing was carried out with a similar paste containing all ingredients but the sodium lignin sulfonate, the printed fabric exhibited many off-colored specks resulting from dye precipitation and was of unsatisfactory commodity value.

EXAMPLE 2

Using the stock paste of Example 1, another printing paste was prepared of the following composition:

| | |
|---|---|
| C.I. Acid Red 138 | 1 part |
| C.I. Basic Red 68 | 1 part |
| Thiodiethylene Glycol | 2 parts |
| Acetic Acid | 2 parts |
| Tartaric Acid | 3 parts |
| Stock Paste | 60 parts |
| Water | 31 parts |
| Total | 100 parts |

A woven fabric produced from blended yarn of 50 parts of commercially available cationic acrylic fibers and 50 parts of wool was printed therewith in accordance with conventional procedure. The printed fabric was steamed at 105°F. for 15 minutes and then washed, rinsed, and dried.

The fabric obtained assumed a pattern of sharp red color in both acrylic and woolen fiber portions. Color fastness and resistance to crocking were good.

By way of contrast, when the above procedure was repeated omitting the sodium lignin sulfonate from the printing paste, the fabric obtained contained numerous specks of precipitated dye and was of unsatisfactory commodity value.

EXAMPLE 3

In this example a fabric of single knit construction of the same fiber composition as in Example 1 was employed. The printing paste was as in Example 1 except that the dyes used were C.I. Reactive Blue 18 as the anionic dye and C.I. Basic Blue 88 as the cationic dye and dye usage was 0.5 part each.

The fabric obtained was of sharp blue pattern level in shade in both fiber components with good color fastness. No evidence of dye precipitation was observed.

EXAMPLE 4

The procedure of Example 2 was followed in all material details except that 1 part of C.I. Acid Red 161 was employed as the anionic dye and 0.5 part of C.I. Basic Yellow 21 was employed as the cationic dye.

The printed fabric showed no evidence of precipitation of dyes and a sharp pattern of blue and yellow was obtained.

By way of comparison, when the above was repeated using a printing paste from which the sodium lignin sulfonate was omitted the fabric obtained contained many specks of precipitated dye and was of unsatisfactory commodity value.

EXAMPLE 5

The procedure of Example 2 was again followed substituting for the dyes used therein 1 part of c.I. Acid Red 161 as anionic dye and 0.5 parts of C.I. Basic Yellow 21 as cationic dye.

A sharp pattern of red and yellow colors was obtained which had good color fastness and high commodity value. The paste was very stable and no precipitation of dyes could be observed.

We claim:

1. A process for printing a fiber assemblage comprising acrylic fibers dyeable with cationic dyes and blend fibers dyeable with anionic dyes with a printing paste containing a cationic dye and an anionic dye which process comprises preparing said printing paste so as to contain lignin sulfonic acid or a soluble salt thereof in an amount by weight greater than the total amounts by weight of cationic and anionic dyes present, printing said fiber assemblage with the thus-prepared printing past and thereafter steaming the thus-treated fiber assemblage to fix the dyes thereon.

2. The process of claim 1 wherein the amount of lignin sulfonic acid or soluble salt thereof is from 2 to 8 weight percent based on the total weight of printing paste.

3. The process of claim 1 wherein steaming is carried out at a temperature in the range of 95°C. to 120°C. for at least about 5 minutes.

4. The process of claim 1 wherein the paste-forming material is carboxymethyl cellulose.

5. The process of claim 1 wherein a printing auxiliary is also present in said printing paste.

6. The process of claim 1 wherein the anionic dye is a reactive dye and a polyamine complex salt is incorporated in the printing paste.

* * * * *